US007156752B1

(12) United States Patent
Bennett

(10) Patent No.: US 7,156,752 B1
(45) Date of Patent: Jan. 2, 2007

(54) GYROSCOPIC GOLF CLUB HEADS

(76) Inventor: John Emmanuel Bennett, 1570 Homewood Dr., Altadena, CA (US) 91001

( * ) Notice: Subject to any disclaimer, the term of this patent is extended or adjusted under 35 U.S.C. 154(b) by 0 days.

(21) Appl. No.: 11/298,004

(22) Filed: Dec. 10, 2005

(51) Int. Cl.
*A63B 53/04* (2006.01)
*A63B 53/06* (2006.01)
*A63B 69/36* (2006.01)

(52) U.S. Cl. ..... 473/334; 473/340; 473/349; 473/350; 473/345; 473/249

(58) Field of Classification Search ..... 473/324–350, 473/230–256, 287–291; D21/733–753, 759
See application file for complete search history.

(56) References Cited

U.S. PATENT DOCUMENTS 1,320,163 A * 10/1919 Maurice ..... 473/335
2,460,445 A * 2/1949 Bigler ..... 473/242
2,463,798 A * 3/1949 Taylor ..... 473/240
3,343,839 A 9/1967 Borah
D209,294 S * 11/1967 Hitt ..... D21/745
3,419,275 A * 12/1968 Winkleman ..... 473/335
3,434,722 A 3/1969 Eposito
D241,563 S * 9/1976 McCord ..... D21/735
4,030,766 A * 6/1977 Derr ..... 473/249
4,326,326 A * 4/1982 MacDonald ..... 29/428
4,422,638 A * 12/1983 Tucker ..... 473/329
4,607,846 A 8/1986 Perkins
4,688,798 A 8/1987 Pelz
4,754,976 A 7/1988 Pelz
4,809,977 A 3/1989 Doran
4,811,949 A * 3/1989 Kobayashi ..... 473/337
4,872,683 A 10/1989 Doran
4,907,806 A * 3/1990 Antonious ..... 473/242
4,962,931 A * 10/1990 Jazdzyk, Jr. ..... 473/252
4,986,544 A * 1/1991 Benson ..... 473/254
5,013,041 A * 5/1991 Sun et al. ..... 473/252
5,046,740 A * 9/1991 D'Eath ..... 473/255
5,104,457 A * 4/1992 Viljoen et al. ..... 473/350
5,121,922 A 6/1992 Harsh
5,242,167 A * 9/1993 Antonious ..... 473/350
5,348,295 A * 9/1994 Phillips ..... 473/307
5,390,918 A 2/1995 Meyers
5,409,228 A * 4/1995 Botsch ..... 473/249
5,482,282 A * 1/1996 Willis ..... 473/342
5,492,329 A * 2/1996 Kronin ..... 473/220
5,683,309 A 11/1997 Reimers
5,688,190 A 11/1997 Rowland
5,690,561 A 11/1997 Rowland
5,707,296 A * 1/1998 Hodgson et al. ..... 473/220
5,788,587 A 8/1998 Tseng
5,910,055 A 6/1999 Bennett (Continued)

*Primary Examiner*—Sebastiano Passaniti
(74) *Attorney, Agent, or Firm*—Stout, Uxa, Buyan & Mullins, LLP; Donald E. Stout

(57) ABSTRACT

This invention creates a new and truly scientifically advanced design and structuring of golf club heads based on Sir Isaac Newton's First Law of Motion. A very precise and controlled path of inertial swing is then developed by this gyroscopic club head. This is accomplished by utilizing a spherical metal weight positioned rearward of the striking surface. Further, a weight is positioned at the club head's center of gravity. Further again, a metal spherical weight is positioned at the club head's center of gravity. All this creates and results in a smooth, easy and natural flowing swing which is in one arc line and in one plane. The concept presented herein, enables the manufacture of unlimited variety of golf clubs.

7 Claims, 12 Drawing Sheets

U.S. PATENT DOCUMENTS

| | | | | |
|---|---|---|---|---|
| 5,967,903 | A | 10/1999 | Cheng | |
| 5,997,409 | A | 12/1999 | Matson | |
| 6,206,790 | B1 * | 3/2001 | Kubica et al. | 473/335 |
| 6,238,302 | B1 | 5/2001 | Helmstetter | |
| 6,273,827 | B1 * | 8/2001 | Hockerson et al. | 473/236 |
| 6,277,032 | B1 * | 8/2001 | Smith | 473/336 |
| 6,443,855 | B1 | 9/2002 | Tseng | |
| 6,471,600 | B1 | 10/2002 | Tang | |
| 6,506,125 | B1 | 1/2003 | Helmstetter | |
| 6,863,617 | B1 | 3/2005 | Park | |
| 6,916,252 | B1 | 7/2005 | Bennett | |
| 2006/0068928 | A1 * | 3/2006 | Nagy | 473/238 |

* cited by examiner

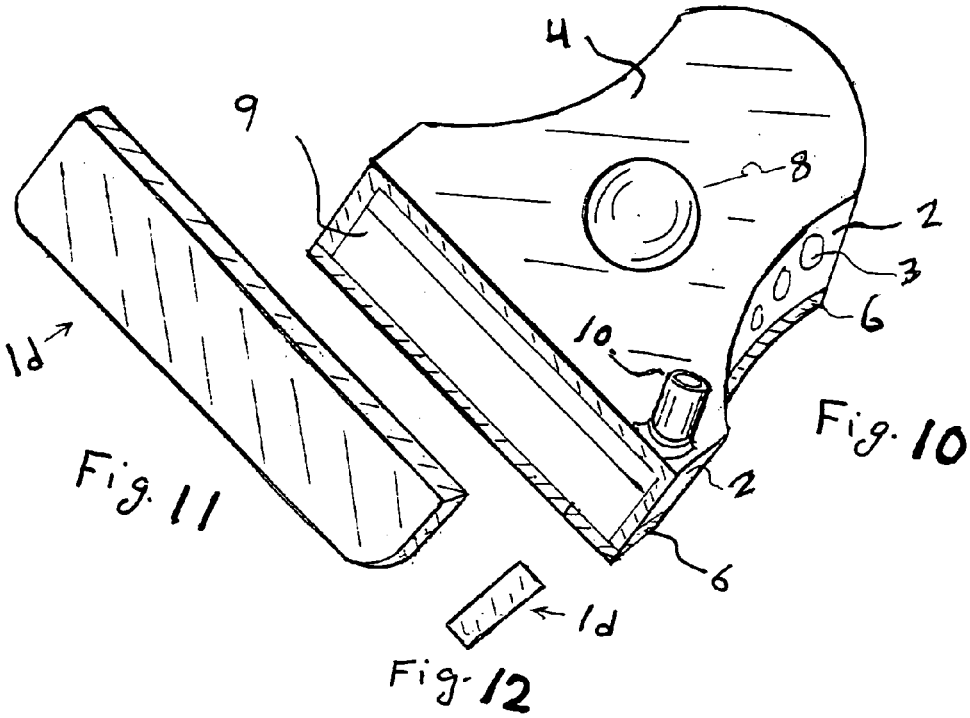
Fig. 10
Fig. 11
Fig. 12
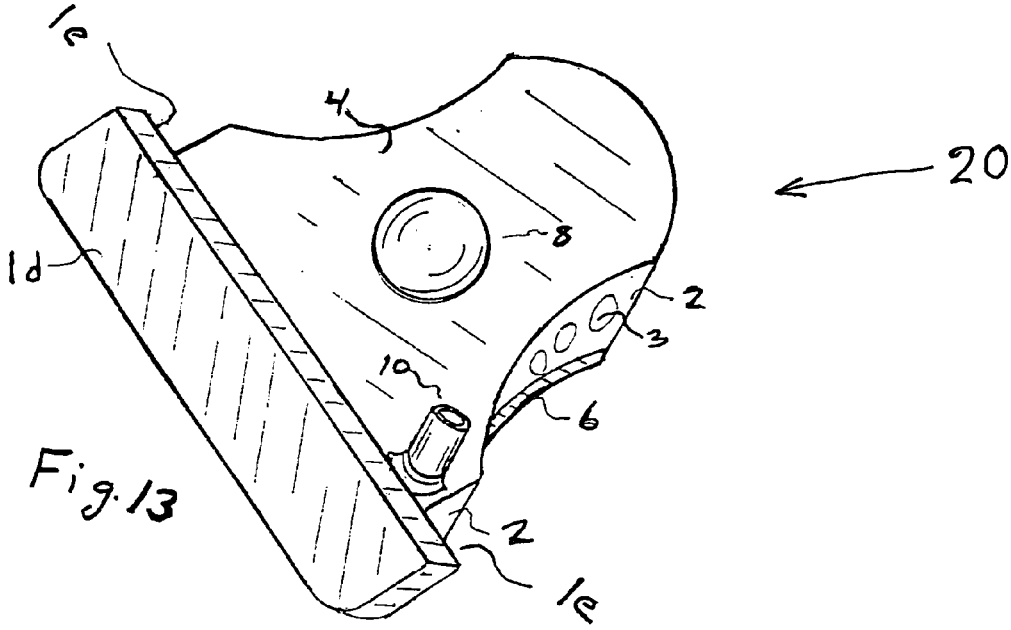
Fig. 13

B-B

A-A 10
10a
1
8c
53a
18

10
10a
20
1
Gyro
8c
18
60
18

A
B
10
10a
52
1
20
60
A
B

53a 53
1
20
8d
53

53
8d
A
B
52
A
B 8d
8e
8c 52
8c

A
B
53a
8d
52
A
B
53

8d
53
8e
52
A
B 10
10a
8d
8e

53

20
1
8c
60
61

53

66
64
65

62

GYROSCOPIC GOLF CLUB HEADS

BACKGROUND OF THE INVENTION

This invention relates to an improved constructional design for golf clubs, and more particularly to advantageous configurations for golf club head.

The game of golf has consumed the weekends and passions of millions of people worldwide for many years, and increasingly so in recent years as its popularity has soared. The reasons for its popularity are legion, and include the beautiful settings in which it is played, the opportunity for leisurely exercise, companionship, and the elusive satisfaction of successfully navigating a small white ball several hundred yards from a golf tee into a small hole, using just a few strokes of a golf club.

Golf clubs are being continually re-designed to assist the golfer in improving his or her game. It would be particularly advantageous to provide a set of clubs of different types (putter, irons, an woods) which are properly balanced and supply cues to the golfer to assist in aligning his or her shots.

SUMMARY OF THE INVENTION

The present invention provides an improved set of golf clubs, wherein each club comprises a "gyroscopic" club head, balanced and activated to function with the center of gravity of the club head. In a preferred embodiment, this objective is accomplished by attaching to the club head a metal spherical weight at the center of gravity of the club head. Preferably, the sphere comprises a uniform configuration, so that the precise center of gravity of the weight, and of the club head, is at the center of the weight. During the swinging of the golf club, the spherical weight assists in creating a gyroscopic feel for the golfer, automatically stabilizing the club head during the swinging motion. The inertia of the spherical weight helps to maintain the club head in one line in one plane so that the player experiences a friendly and precisely controlled swing.

In one embodiment of the invention, the spherical weight is positioned at the back surface of the club head blade, at the center of gravity of the club head, which is at the back of the "sweet spot", of putters and various irons. The spherical weight is positioned at the center of gravity within the club head for the case of a wood. Also disclosed is a mallet type of club head made from solid material or as a shell housing. Within such a housing, a sphere is located at the center of gravity and another sphere, as a weight, is positioned, in line, at the rear portion of the club head. This unique type of mallet club head embodies an extended blade across its front in order to provide the "feel" of a blade type putter. This putter also embodies three lines and specific markings to accurately align the club head with the target.

In another embodiment, a blade type club head is provided with only a spherical weight disposed at the back surface of the blade at its center of gravity, while a similar club head comprises a weight on each side of the sphere.

In another aspect of the invention, a thin layer of plastic film is placed on the striking face of putters and irons. This film is attachable and removable at the option of the player. This layer of film provides a "soft-hard" feel at impacting the ball, enabling an improvement in accuracy.

Further, a particular putter embodiment comprises a hybrid gyroscopic putter wherein the body of a mallet type club head is combined with an extended striking blade, as in a blade-type putter, attached across the front of the mallet body and extending significantly beyond each side of the mallet club head body.

The invention, together with additional features and advantages thereof, may best be understood by reference to the following description taken in conjunction with the accompanying illustrative drawings.

The concept herein, enables the manufacture of unlimited variety of golf club heads. dr

BRIEF DESCRIPTION OF THE DRAWINGS

FIG. 10 is a perspective view of a club head similar to that shown in FIG. 5, which is modified to accommodate a separate striking blade;

FIG. 11 is a perspective view of a separate striking blade which is attachable to the club head of FIG. 10;

FIG. 12 is a top view of the separate striking blade of FIG. 11;

FIG. 13 is a perspective view of the club head of FIG. 10, wherein it is assembled with the striking blade of FIG. 11;

FIG. 26 is a perspective view, from the top, of still another blade-type putter head embodiment, having a spherical weight disposed therein;

DESCRIPTION OF THE PREFERRED EMBODIMENT

Referring now more particularly to the drawings, it is noted that the disclosed invention is primarily a gyroscopically functioning golf club head, which is maintained, in preferred methods according to the invention, in one line, in one plane. There are two major concepts underpinning the invention, derived from Newton's First Law of Motion.

A first concept according to the invention involves the employment of a sphere, preferably of metal, as a weight on the club head. A second concept is the positioning of the metal sphere at the center of gravity of the club head. The metal sphere, because of its substantially uniform configuration and concentration of its weight, at a point substantially at its center of gravity, develops a strong, uniform and sustained inertia, providing a gyroscopic effect to the club head while it is in motion.

Positioning, coinciding, and combining the center of the gravity of the sphere with the center of the gravity of the body of the club head, enhances the centers of gravities, resulting in a more positive and greater inertial force, and consequently developing an easier club to manage and perform with.

As for the center of gravity, it is axiomatic that all bodies embody their own unique center of gravity, corresponding to their unique configuration, shape, size, weight, and distribution of weight. Different bodes have different centers of gravity. This same concept, utilizing a solid sphere as a weight positioned at the club head's center of gravity, is applicable and applied to various golf club heads in this invention. In the terminology of the game of golf, these include shell and solid types of putter heads, blade-type putter heads, as well as the heads of irons, wedges, and woods.

Figure 3:
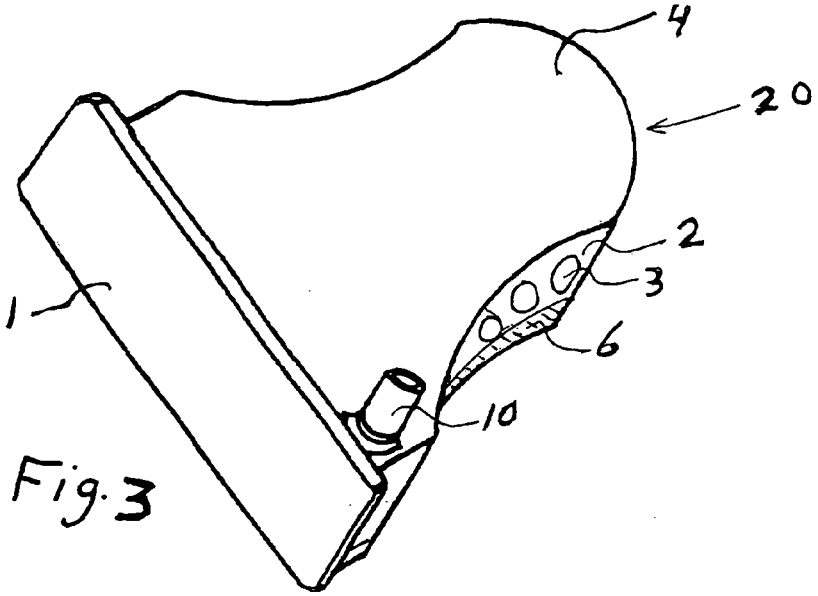
FIG. 3 is a top view of a bottom plate for use with the club head of FIG. 2.
Figure 2:
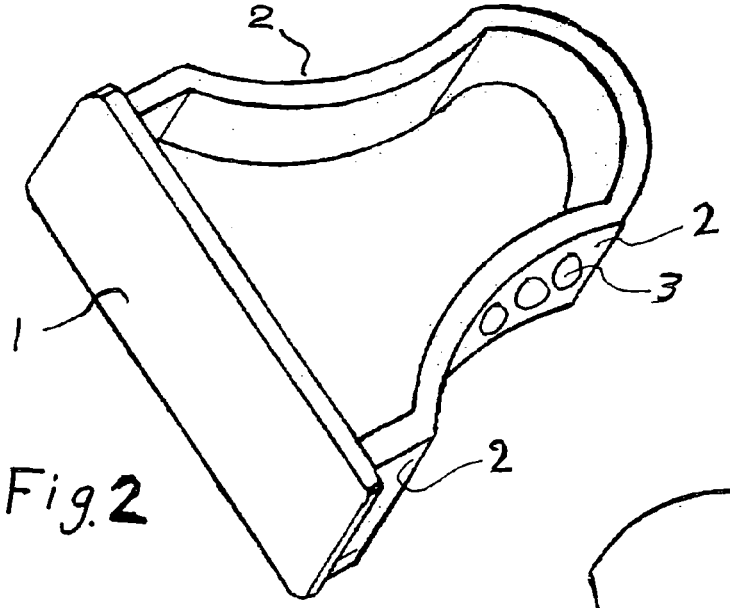
FIG. 2 is a top perspective view of a club head similar in construction to those shown in FIGS. 1*a*–1*c,* with a bottom plate removed therefrom.
Figure 4:
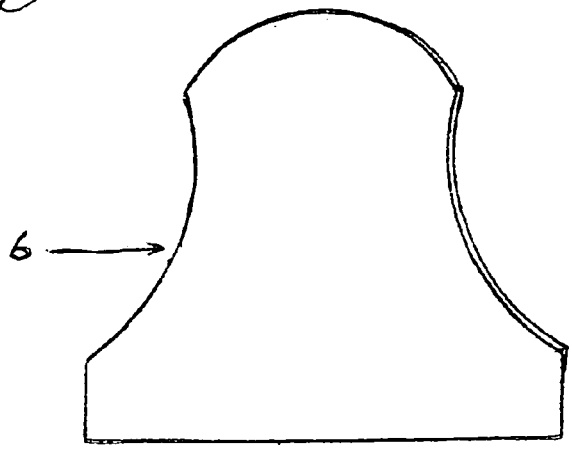
FIG. 4 is a top perspective view of the club head of FIG. 2 assembled together with the bottom of FIG. 3.
Figure 9:
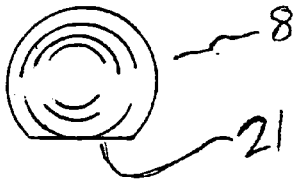
FIG. 9 is a side view, in isolation, of a spherical weight for use in the disclosed invention.

Referring now more particularly to the drawings, FIGS. 2–4 illustrate a typical "mallet-type" putter head, made as a hollow shell and constructed in accordance with the principles of the present invention. As illustrated, a club head 20 comprises a striking blade 1, a separator rim 2, a plurality of openings 3, a top 4, a bottom plate 6, and a sleeve 10, for receiving and accommodating the club shaft. The club head comprises a shell housing which is cast as a unit, except for the bottom plate 6 which is cast or stamped separately. The housing 20 and the bottom plate 6 are preferably fabricated of aluminum, steel, brass, titanium, or a combination thereof.

Desired weights are positioned in and attached to the bottom plate 6, and inserted into the body 20. As shown in FIGS. 5–9, such weights may include generally spherical weights 8 and 8*a,* of various sizes, disposed on the plate 6 using suitable attachment means, such as an epoxy adhesive or the like. The size of the metal spheres 8, 8*a* is determined by the desired results for the particular club, as well as by the location of the sphere on the club head body. Preferably, the portion 21 of the surface of the spherical body 8, 8*a* which is disposed on the plate 6 is slightly flattened in order to facilitate engagement of the body 8 with the plate 6. In one preferred embodiment, the body 8 has a diameter of less than ¾ inches, and a weight of less than 20 ounces. Alternatively, a cavity within the body of the club head is provided for accommodating the weight, which is epoxied therein.

Figure 6:
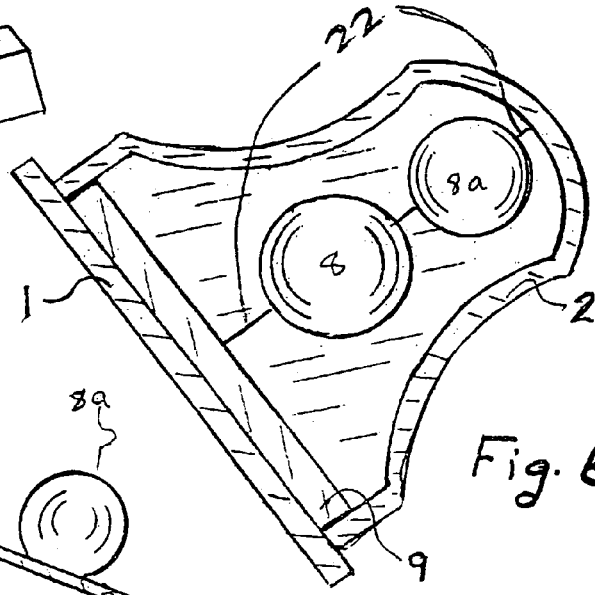
FIG. 6 is a cross-sectional view of the club head of FIG. 5, taken from the top thereof.
Figure 7:
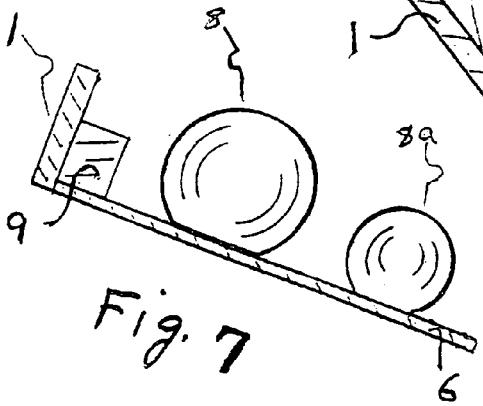
FIG. 7 is a cross-sectional view from the side of the club head of FIGS. 5 and 6.
Figure 14:
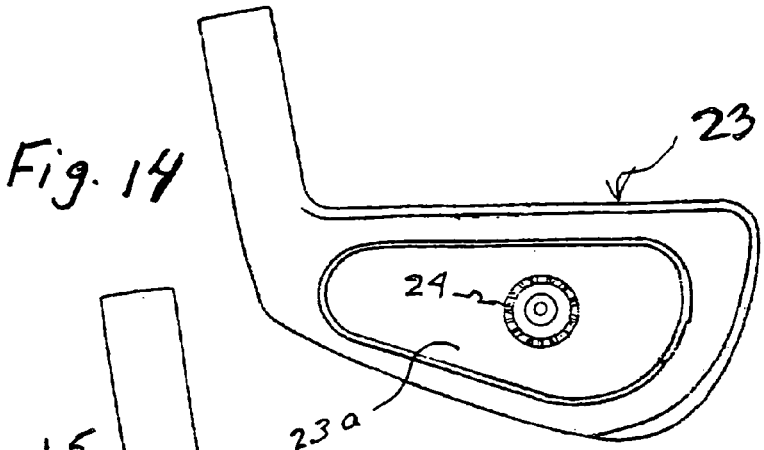
FIG. 14 is a side view of, from the rear, a club head suitable for an iron type of club, having a cavity disposed therein for receiving and accommodating a suitable weight.
Figure 15:
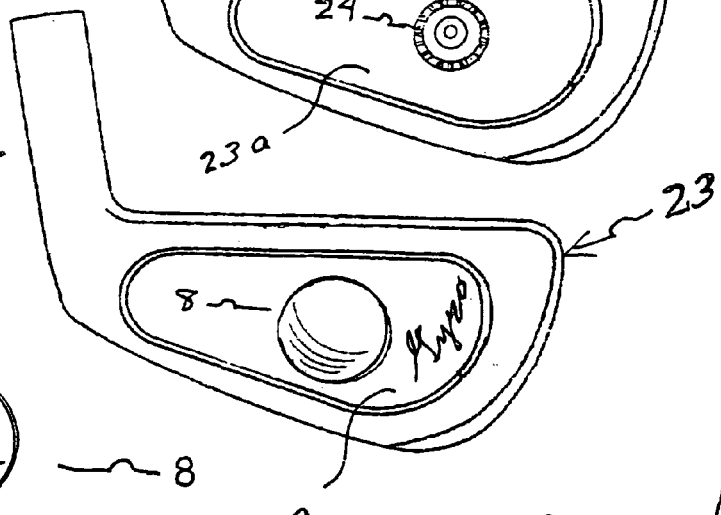
FIG. 15 is a view similar to FIG. 14, showing a weight disposed in the cavity.
Figure 16:
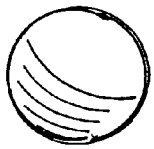
FIG. 16 is a view of the weight, in isolation, which is illustrated in FIG. 15.
Figure 17:
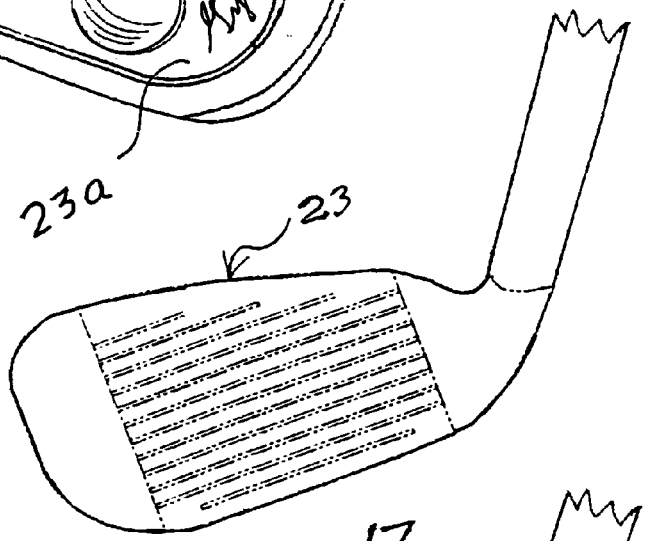
FIG. 17 is a side view, from the front, of the club head shown in FIGS. 15–16, showing the striking face of the club head.
Figure 19:
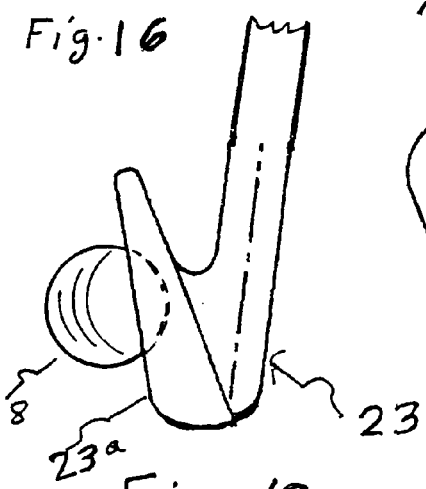
FIG. 19 is a perspective view of the club head of FIGS. 14, 15, and 17, showing the insertion of the weight of FIG. 16 therein.

In addition to the generally spherical bodies 8, 8*a,* other shapes of weights, such as the rectangular weight 9, may be employed. As shown particularly in FIGS. 6 and 7, one preferred arrangement includes a smaller spherical weight 8*a* at the rear of the club, a larger spherical weight 8 forwardly of the weight 8*a,* and a polygonal weight 9 disposed directly behind the striking blade 1. Each of these weights is positioned so that their respective centers of gravity are disposed along a line running through the center of the club head 20, from the striking blade 1 rearwardly, perpendicular to the striking blade 1. Preferably, the center of gravity of the club head 20 also lies along this imaginary line 22 (FIG. 6). It should be noted, however, that different arrangements, as well as different numbers and types of weights, may be employed, depending upon desired characteristics of the clubs being manufactured.

Referring now particularly to FIGS. 10–13, there is shown a slightly modified embodiment of the putter club head illustrated in FIGS. 2–9. This type of putter, although it has a mallet-type body, is entirely different than conventional mallet club heads. In conventional mallet club heads, the striking area is narrow and surrounded by a frame of the body, thus restricting further the striking area. Moreover, the concern is that the mallet club heads do not have a good positive feel when striking the ball, because of their relatively massive construction in the rear of the club head. Blade club heads, in general, have a more positive feel for striking the ball.

The mallet club head illustrated in FIGS. 10–13 embodies a longer blade 1, extending laterally beyond the sides of the body 20. Extensions 1*e,* disposed on either end of the blade 1*d,* are shown particularly in FIG. 13. This creates a new type of club head, having a mallet-type construction, but a blade putter type of feel. The blade portions 1*e* extend up to 0.75 inches beyond the sides of the body 20 on each end of the blade 1*d,* in the preferred embodiment.

This new type of hybrid mallet-blade club head, as shown in FIG. 13, has both the known advantages of a mallet club head, as well as the advantages, good balance and a good feel of striking the ball, of a blade-type club head.

In one preferred embodiment, the width of the club head body 20 is approximately 3½ inches (within a tolerance of ¼ inch), and the length of the blade, including extensions 1*e,* is approximately 5 inches. The height of the blade is ⅞ inches, within a tolerance of ¼ inch, and its thickness is ⅜ inches.

When the blade 1*d* is constructed of the same material as the club head body 20, the club head, less the bottom plate, is cast as a unit, wherein the unit may be entirely aluminum, steel, or titanium, If a different material is used for the blade, such as steel or brass, then the body, without the blade and the bottom plate, is cast in aluminum, and the blade and the bottom plate are later attached to the body, using suitable construction techniques.

Now referring to FIGS. 14–19, there is shown a club head 23 constructed in accordance with the principles of the invention, for an iron or wedge, rather than a putter. The club head 23 comprises a cavity 24 for accommodating a spherical weight 8, as illustrated. The spherical weight 8 is positioned and attached at the approximate center of gravity of otherwise conventional club heads 23, at the back surface of the blade. The cavity 24 is fashioned to correspond to the curvature of the spherical weight 8, with an outer diameter, preferably, of less than 0.75 inches.

Figure 20:
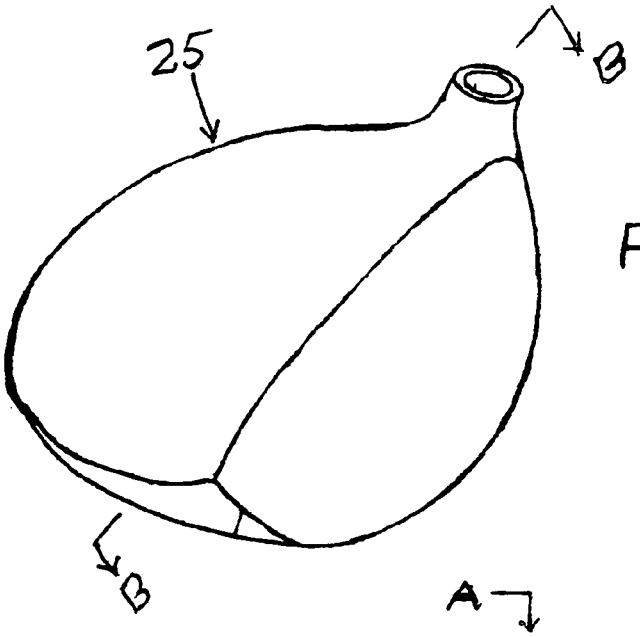
FIG. 20 is a perspective view of a club head suitable for a wood type of club.
Figure 21:
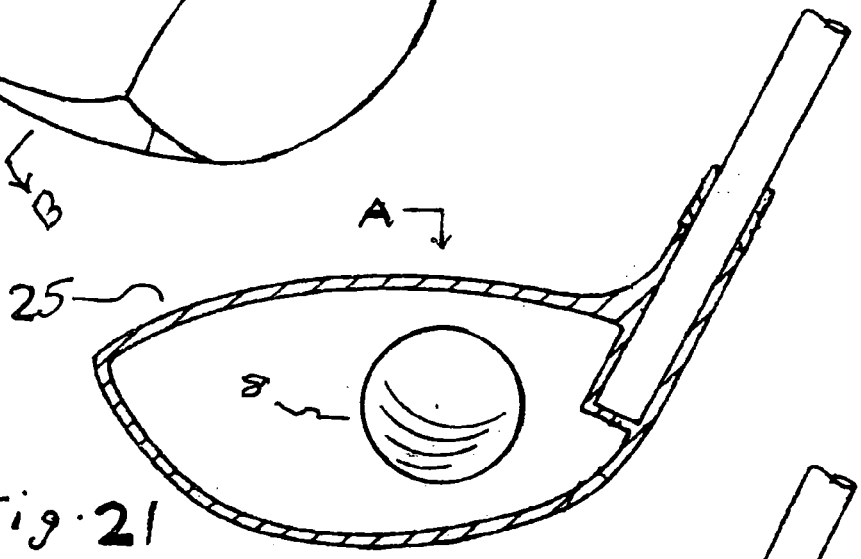
FIG. 21 is a cross-sectional view taken along lines B—B of the club head of FIG. 20, wherein a spherical weight has been inserted therein.
Figure 21A:
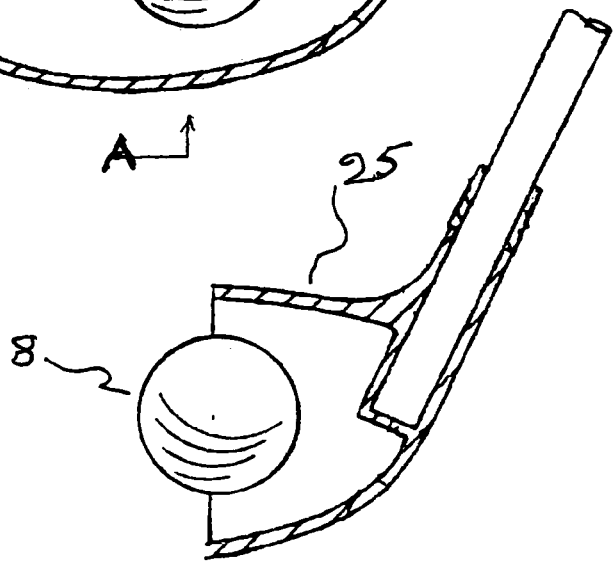
FIG. 21*a* is a cross-sectional view taken along lines A—A of the club head of FIG. 21.
Figure 22:
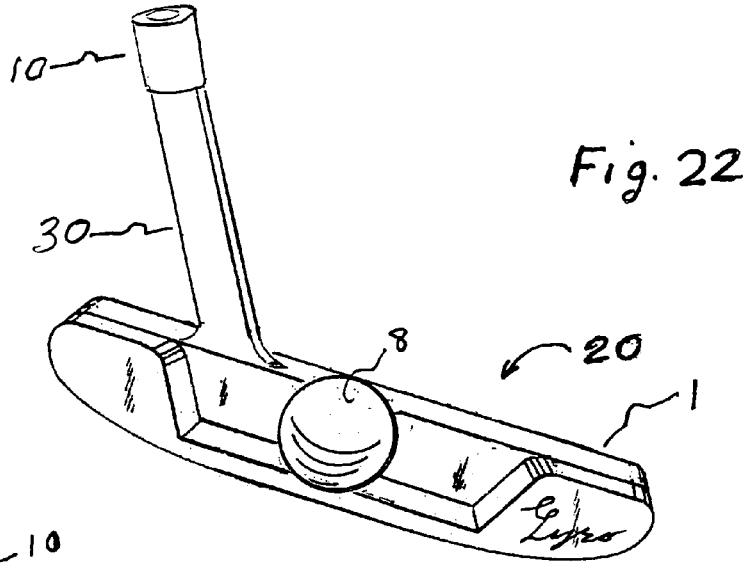
FIG. 22 is a perspective view of yet another putter head embodiment having a spherical weight installed thereon.
Figure 23:
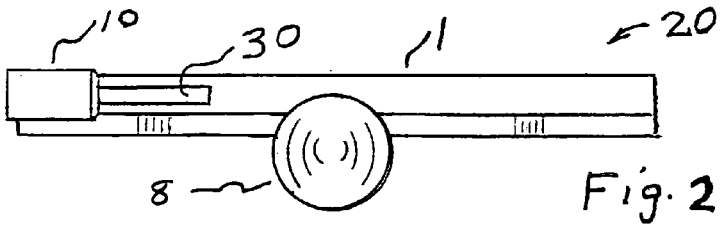
FIG. 23 is a top view of the putter head of FIG. 22.
Figure 24:
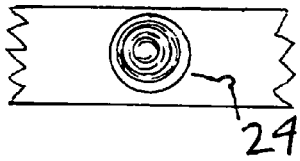
FIG. 24 is an isolated view of the rear surface of the putter head of FIGS. 22–23, showing a cavity disposed therein for accommodating the spherical weight.
Figure 25:
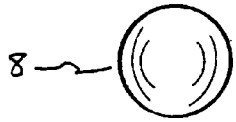
FIG. 25 is an end view of the putter head of FIG. 22.
Figure 25:
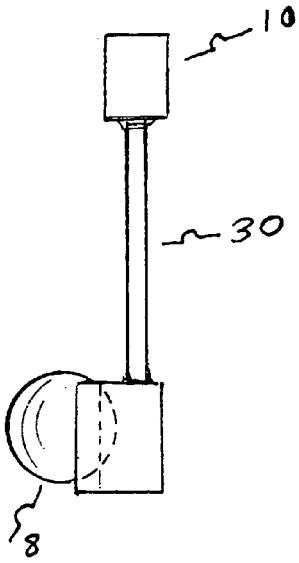

FIGS. 20–21*a* illustrate yet another embodiment of the present invention for long distance clubs such as woods, drivers, and the newer metal woods. These types of clubs have a more three dimensional club head body 25, and the spherical weight 8 is positioned within the body, preferably at or near the center of gravity of the club head 25 (FIGS. 21 and 21*a*). The spherical weight 8 is preferably fashioned of steel, lead, brass, tungsten, and the like, and is affixed in position using an epoxy adhesive or other suitable attachment means. Since tungsten is relatively heavy, the size of a tungsten weight is relatively small compared with those made of other lighter metals. It should be noted, at this juncture, that these weights, though preferably spherical, may also be fabricated of alternative shapes. However, if the shape is asymmetrical, the resultant club head will not be perfectly balanced when the weight is placed at the center of gravity of the club head, so the weight should preferably be of a symmetrical shape.

When the aforementioned weight is properly positioned in the club head, control of the swing will be greatly improved, since the club head is maintained in a single line path, in a single plane. The swing will be more friendly, and feel accommodating. Further, the alignment of the club head with the target is truer and the accuracy of the swing is advantageous.

Figure 1A:
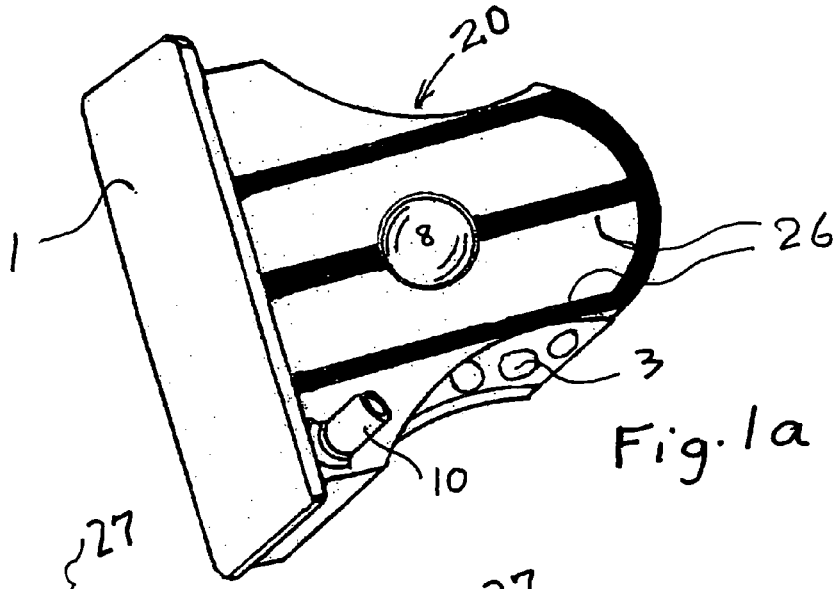
FIGS. 1*a*–1*c* are top perspective views of an embodiment of the present invention, illustrating the employment of three variants of alignment systems for assisting a golfer in aligning the club head with an intended target.
Figure 1B:
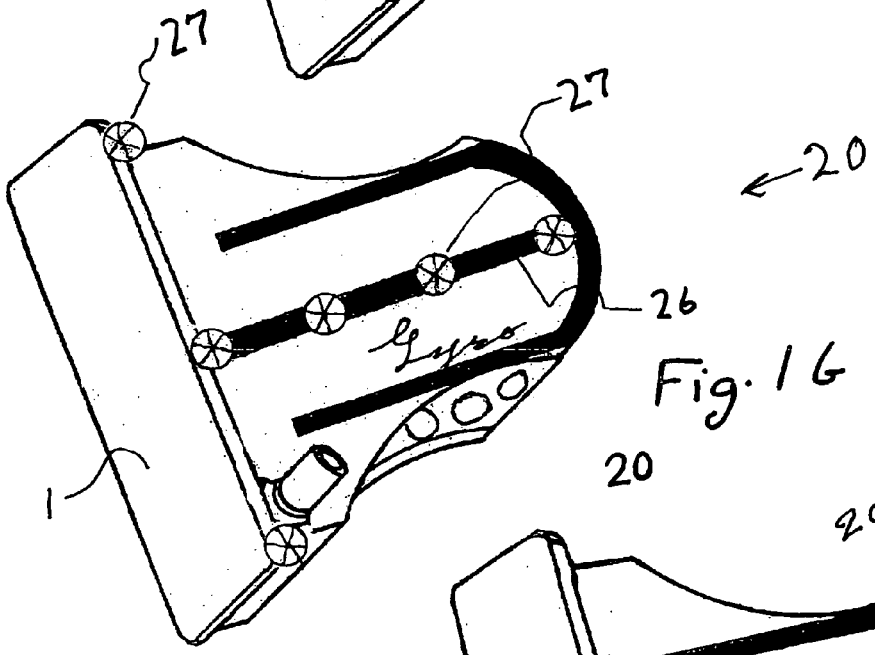
Figure 1C:
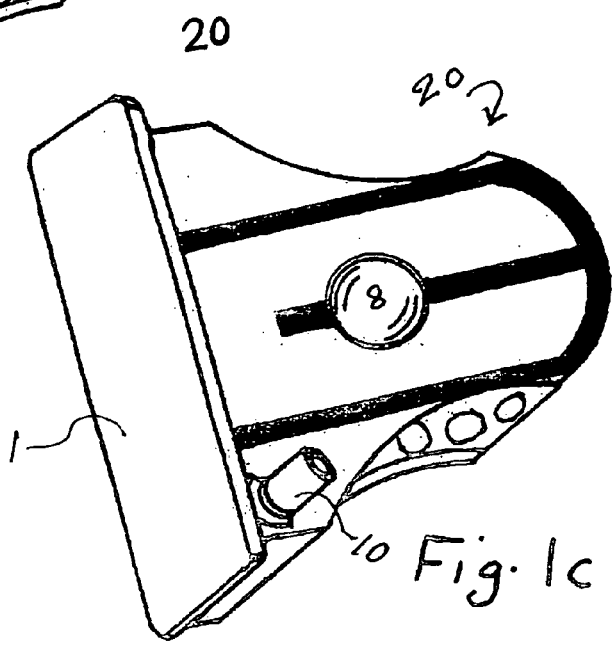

FIGS. 1*a*–1*c* illustrate yet another feature of the present invention, particularly related to an alignment system for use with a putter, in order to align the club head precisely with the target. The putter head 20 illustrated in FIGS. 1*a*–1*c* is similar to that shown in FIGS. 2–13. As shown in FIGS. 1*a*–1*c,* three parallel lines 26 are disposed along the top of the head 20, extending perpendicularly rearwardly from the striking blade 1, to the rear of the club head. The outer two lines are positioned symmetrically about the center line, preferably less than 1¼ inches from the center line, and these lines are also ¼ inch to 1 inch shorter than the length of the center of the three lines 26. These lines function to assist the golfer in aligning the club head as desired by relying on the concept of parallax. Additional marking elements 27, as shown in FIG. 1*b,* are arranged on the club head to further assist in the alignment process. These marking elements 27 may comprise painted marks, objects of brilliance and color, such as gems, glass, chrome, and the like, or even other ordinary markings. These marking elements 15 are placed in a row, along a line substantially perpendicular to the orientation of the striking blade 1 (shown in FIG. 1*b* as being coincident with the center line 26), preferably bisecting the club head. Additional marking elements 27 are disposed on each end of the striking blade 1, as shown. The marking elements may be either flush with the surrounding surface, or raised, as desired.

With both the marking elements 27, and the parallel lines 26, a parallax effect is created when attempting to align the club head with the intended target. When the markings are at an angle with the target, a parallax image appears. When aligned, the parallax image disappears, thus indicating to the player that alignment is correct.

Still another feature of the present invention is the optimal employment of a dampening element on the striking surface of the club head. This dampening element functions to prevent a sudden shock affect on the ball at impact, thereby providing a purer release of the ball and achieving greater accuracy. A preferred material 6 for fabricating the dampener is one of TEFLON®, urethane, polyvinyl chloride (PVC), polyethylene, or other suitable material. Two different finishes may be employed on the dampener. One is polish smooth, surface finish equivalent to Society of Plastic Engineers Specification SPI-SPE-1. The other finish is textured, similar to sandpaper having a grit size of between 60 and 480.

The aforementioned dampener material is preferably placed on the striking surface of the club head, and not interested. The shape and size of the dampener element conforms to the shape and size of the striking surface. The thickness of the smooth finished dampener is preferably less than about 0.032 inches, and the thickness of the textured dampener is preferably less than about 0.060 inches.

Figure 5:
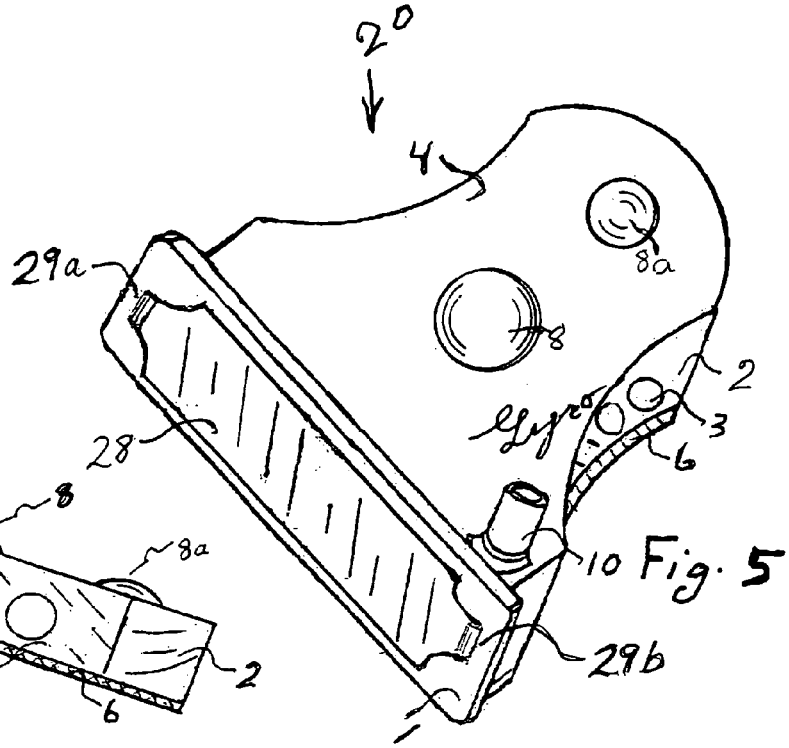
FIG. 5 is a top perspective view of a club head similar to that shown in FIGS. 2–4, having both a plurality of weights disposed therein and having a dampener element disposed on the striking blade thereof.
Figure 8:
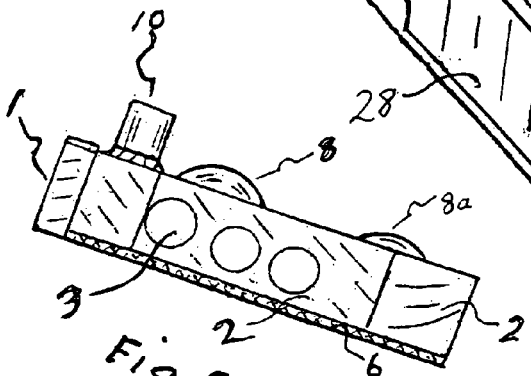
FIG. 8 is a side view of the club head of FIGS. 5–7.
Figure 7A:
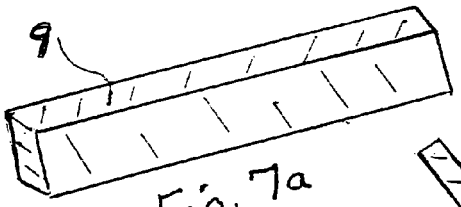
FIG. 7*a* is a perspective view, in isolation, of a rectangular weight for use in the club head of FIG. 7.
Figure 18:
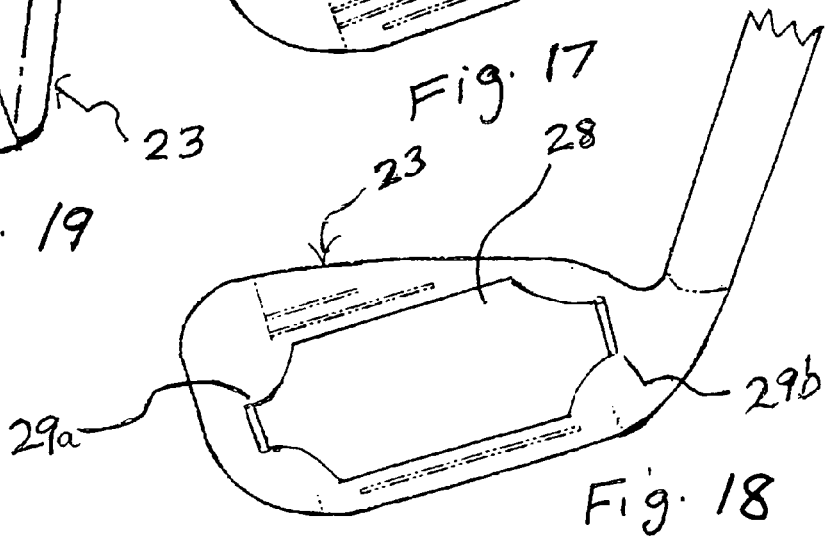
FIG. 18 is a side view, similar to FIG. 17, wherein a dampener element has been installed on the striking face thereof.

A dampener element 28 of the type contemplated is illustrated in FIG. 5, for use with a putter, and FIG. 18, for use with an iron club. The dampener element 28 preferably comprises a removable backing adhesive known in the market at "remount repositionable adhesive", and does not affect the surface where used. The dampener element 28 further comprises a tab 29*a*, 29*b* at each end thereof (FIGS. 5 and 18). The dampener element is applicable, removable, or permanently set as desired by the golfer. If desired, multiple layers of the dampening element 28 may be applied, in order to provide various thicknesses as desired by the golfer. The thin dampening element 28, placed directly on the metal striking surface of the club head, creates a "soft-hard" controlled feel upon impacting the ball, releasing the ball freely without shock, vibrations, or slight lateral motions of the club head at impact.

Still another embodiment of the present invention is illustrated in FIGS. 22–25. Shown is a conventional blade-style putter head 20, on which is disposed a spherical weight 8. A hosel 30 extends upwardly from the putter head 20 for accommodating the sleeve 10. A cavity 24 is disposed on the surface of the putter head 20 for receiving the weight 8, which is, as in the other illustrated embodiments, preferably epoxied into place, and disposed as closely as possible to the center of gravity of the putter head 20.

Figure 26A:
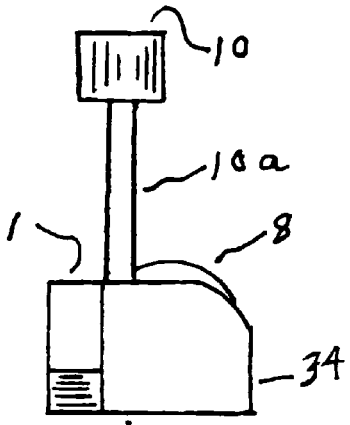
FIG. 26*a* is an end view of the putter head illustrated in FIG. 26.
Figure 26B:
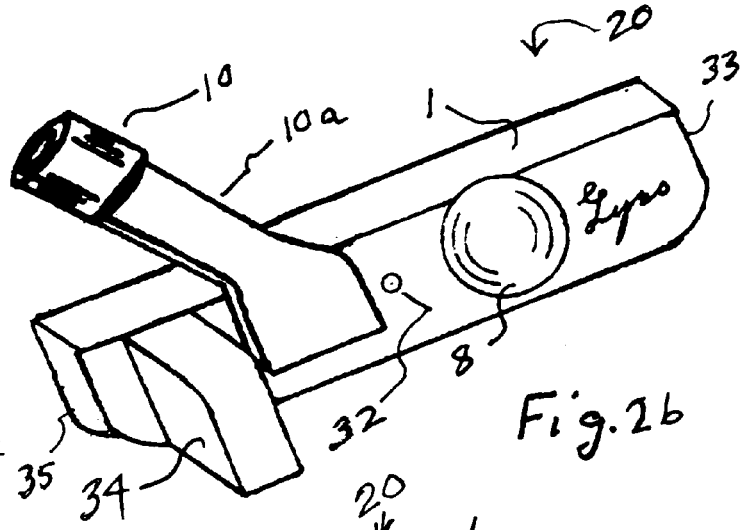
FIG. 26*b* is a top view of the putter head illustrated in FIG. 26.
Figure 26B:
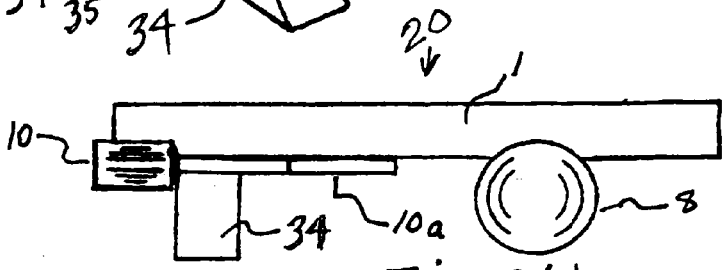

Yet another putter embodiment is shown i FIGS. 26, 26*a*, and 26*b*. The putter clubhead 20 is a blade-type club head, having a striking blade 1 and a weight 8 disposed on the back of the blade as shown. The weight 8 is preferably disposed at an offset and off center position, less than 1 inch away from the blade's intrinsic center of gravity 32 (the so-called "sweet spot"), toward the toe 33 of the blade. Preferably, the weight 8 comprises a metal sphere weighing less than 15 oz. and more than 2 oz, but it also may be comprised of other shapes, such as rectangular. The weight 8 is preferably disposed less than 2½ inches from the shaft mounting (hosel), as shown.

Because of the spherical dominant weight 8, and its offset positioning, the club head, at impact, moves forwardly through the golf ball in a fixed setting, because of its inertia and momentum. The forward thrust of the spherical weight's inertia, and its offset positioning, creates a leveraged force and support which maintains the blade and the cub head fixed and rigid when impacting the ball. Further, wobble and torque of the blade is prevented around the shaft mounting, which is less than 3 inches from the weight 8.

A wide striking surface and area is created on the front surface 1 of the blade, corresponding to the position between the weight and the mounting of the shaft, at the rear of the blade. A large portion of this striking area, corresponding to within an inch from the weight 8 at the rear surface, becomes an area where the ball can be struck properly and accurately as though being struck at a single sweet spot. Thus, the "sweet spot" area is increased greatly, which provides a much better chance of accurate and proper impacting of the ball.

A unique hosel stem 10*a* is provided, which comprises a flange for mounting the clubs that (not shown) to the club head. The flange is at the end of the stem 10*a* and resembles a side of a square, which is less than 1 inch square. This flat flange arrangement for mounting the hosel provides a wider backing of the blade at impact, further supporting the blade from wobbling, whereas, the attachment of a circular stem to the blade, as in conventional putters, permits a moment of inertia around the circular mounting, making the blade less secure when impacting the ball.

An insignificant weight 34, which may be of any desired configuration, is disposed near the heel 35 of the blade, as illustrated, for ballast.

Figure 27A:
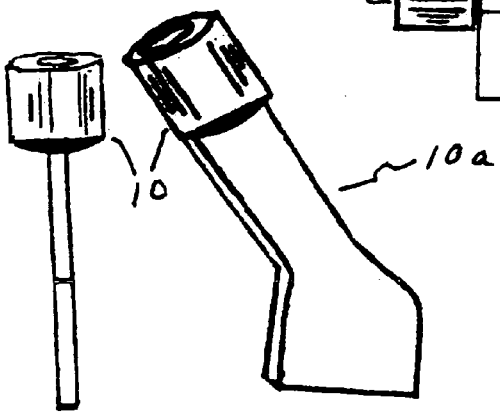
FIG. 27*a* is a perspective view, in isolation, of the hosel of the putter of FIG. 27.
Figure 27:
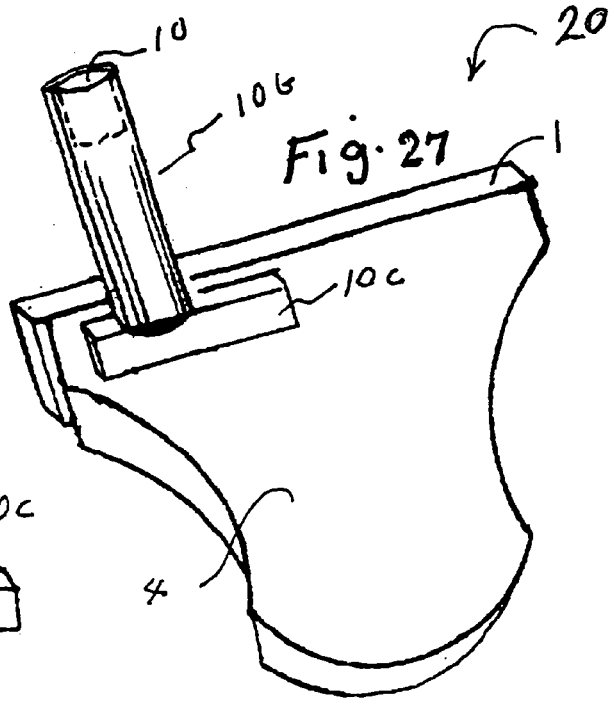
FIG. 27 is a perspective view, from the top of another putter embodiment.
Figure 27B:
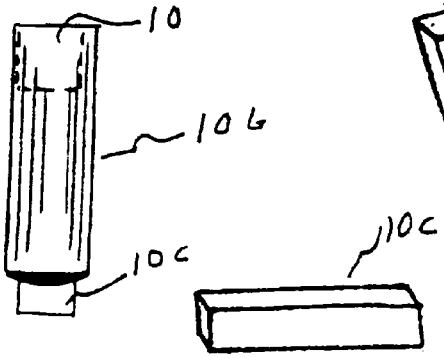
FIG. 27*b* is a perspective view, in isolation, of a portion of the hosel of the putter of FIG. 27.

A further modified putter embodiment is illustrated in FIGS. 27, 27*a*, and 27*b*. This mallet-type putter head 20 comprises a further modified hosel stem 10*b*, which is hollow, and internally accommodates the sleeve 10. A connection member 10*c* attaches the hosel stem 10*b* to the club head 20, as shown, and also functions as a weight for improving the functionality of the putter.

Figures 28, 28A, 28B, 29, 30, 31, 32, 32A, 32B, 32C:
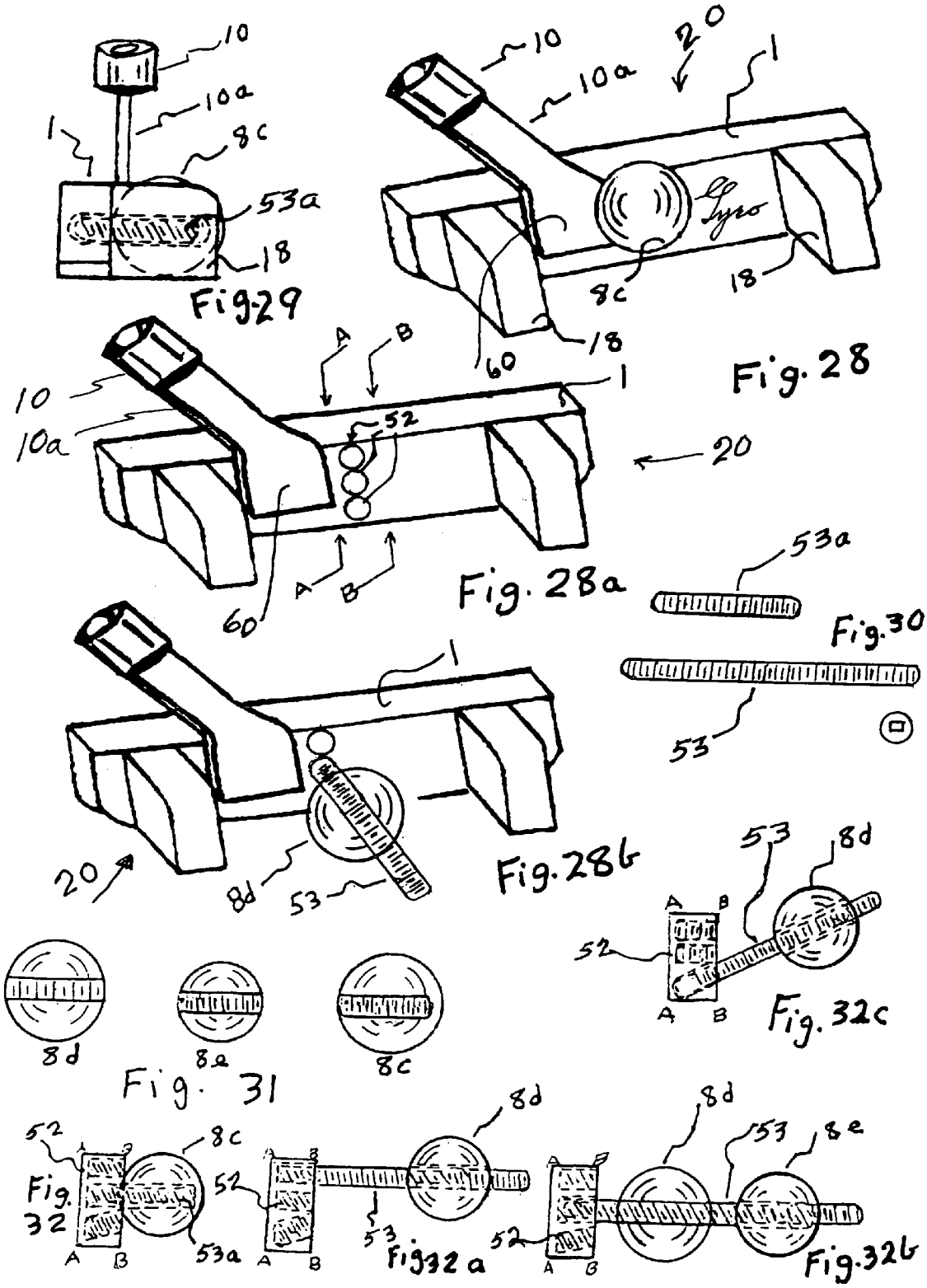
FIG. 28 is a perspective view of still another blade-type putter embodiment.
FIG. 28*a* is a perspective view, similar to FIG. 28, of a slightly modified version of the embodiment of FIG. 28.
FIG. 28*b* is a perspective view, similar to FIGS. 28 and 28*a,* of a slightly modified version of the embodiments of FIGS. 28 and 28*a;*
FIG. 29 is a view showing the hosel portion of the club of FIG. 28.
FIG. 30 is an elevation of a lead screw used in any of the embodiments of FIGS. 28, 28*a,* and 28*b* to position a weight on the putter head.
FIG. 31 is a cross-section view of selected weight spheres having a lead screw disposed therethrough.
FIG. 32 is a cross-sectional view illustrating the securement of a spherical weight to a putter blade.
FIG. 32*a* is a cross-sectional view similar to FIG. 32 wherein the weight is spaced from the blade along a lead screw.
FIG. 32*b* is a cross-sectional view similar to FIG. 32, wherein there are two spherical weights secured thereto.
FIG. 32*c* is a cross-sectional view similar to FIGS. 32–32*b* wherein the lead screw is inserted into an angled receiving hole.

Yet another blade-type putter embodiment is shown in FIGS. 28–30. This embodiment uniquely employs a lead screw with movable and interchangeable weights 8*c*, 8*d*, and/or 8*e* which can be positioned at the center of gravity or as desired.

The blade 1 employs three vertically spaced holes 52, as shown in FIG. 28*a*. In the illustrated embodiment, these holes 52 are disposed along a vertical line which is substantially coincident with the center of gravity of the blade. The upper two holes 52 are substantially level, though the blade 1, while the lower hole 52 is disposed to be oriented upwardly from front to rear of the blade, as shown in FIGS. 32*a*, 32*b*, and 32*c*. A lead screw 53 or 53*a* (FIG. 30) and one or more spherical weights 8*c*, 8*d*, 8*e* (FIG. 31), having a threaded hole therethrough, are provided.

The lead screw 53 is used to mount the weights 8*c*, 8*d*, 8*e* to the club head 20, by threading the lead screw through the hole in the weight to be mounted (FIGS. 28*b*, 31, 32, 32*a*, 32*b*, 32*c*), and then threading the end of the lead screw 53 or 53*a* through one of the three holes 52, as shown in FIGS. 32, 32*a*, 32*b*, and 32*c*. The short lead screw 53*a* may be used to position the weight 8*c* (FIG. 32) directly at the center of gravity (or other desired location) at the rear surface of the blade. The longer lead screw 53 is used to mount the weights, with an Allen wrench or other suitable tool, as necessary, so that the weights are movable along the lead screw, as shown in FIGS. 32*a*, 32*b*, and 32*c*. As shown in FIG. 32*b*, the longer lead screw can also be used to accommodate a plurality of weights 8*d*, 8*e*, if desired.

A preferred lead screw embodiment is less than 0.375 inches round, and 2.50 inches long, with a thread pitch greater than 28, though any suitable threaded screw may be used.

A club head of the type illustrated, without a spherical weight, has a definite center of gravity. The spherical weight also has a definite center of gravity at its physical center. When the spherical weight 8*d* (FIG. 32*a*) is moved, by rotation of the lead screw 53, along the screw 53, so that the two respective centers of gravity coincide, the established center of gravity of the entire combination is compounded, and becomes more effective. This creates a superior club head with respect to balance, "feel", control, accuracy, and performance.

As mentioned above, the versatility of the inventive balancing system is enhanced when a second spherical weight 8*e* is added, as shown in FIG. 32*b*.

As shown in FIG. 32*c*, the lead screw 53 may be threaded into the lowermost hole 52, at an angle, in order to lower the impacting force to the lowest point of the blade, and to the ball, thus improving the spin on the golf ball in flight.

A unique hosel arrangement is illustrated in FIG. 28*a*, wherein the hosel stem 10*a* includes a flat flange 60 at its bottom, preferably less than 0.375 inches in thickness, and less than 1.25 inches square. The flange 60 is mounted on the back surface of the blade 1, for a more positive control of the club head and to minimize torque.

The club head 20 is preferably fabricated by casting without the weight and the lead screw, which are attached later to the casting. The casting may be brass, steel, aluminum, or another suitable material. The weight 8*c*, 8*d*, 8*e* may be made of lead, steel, brass, or the like.

Figures 33, 33A, 33B, 33C, 33D, 34, 35, 36:
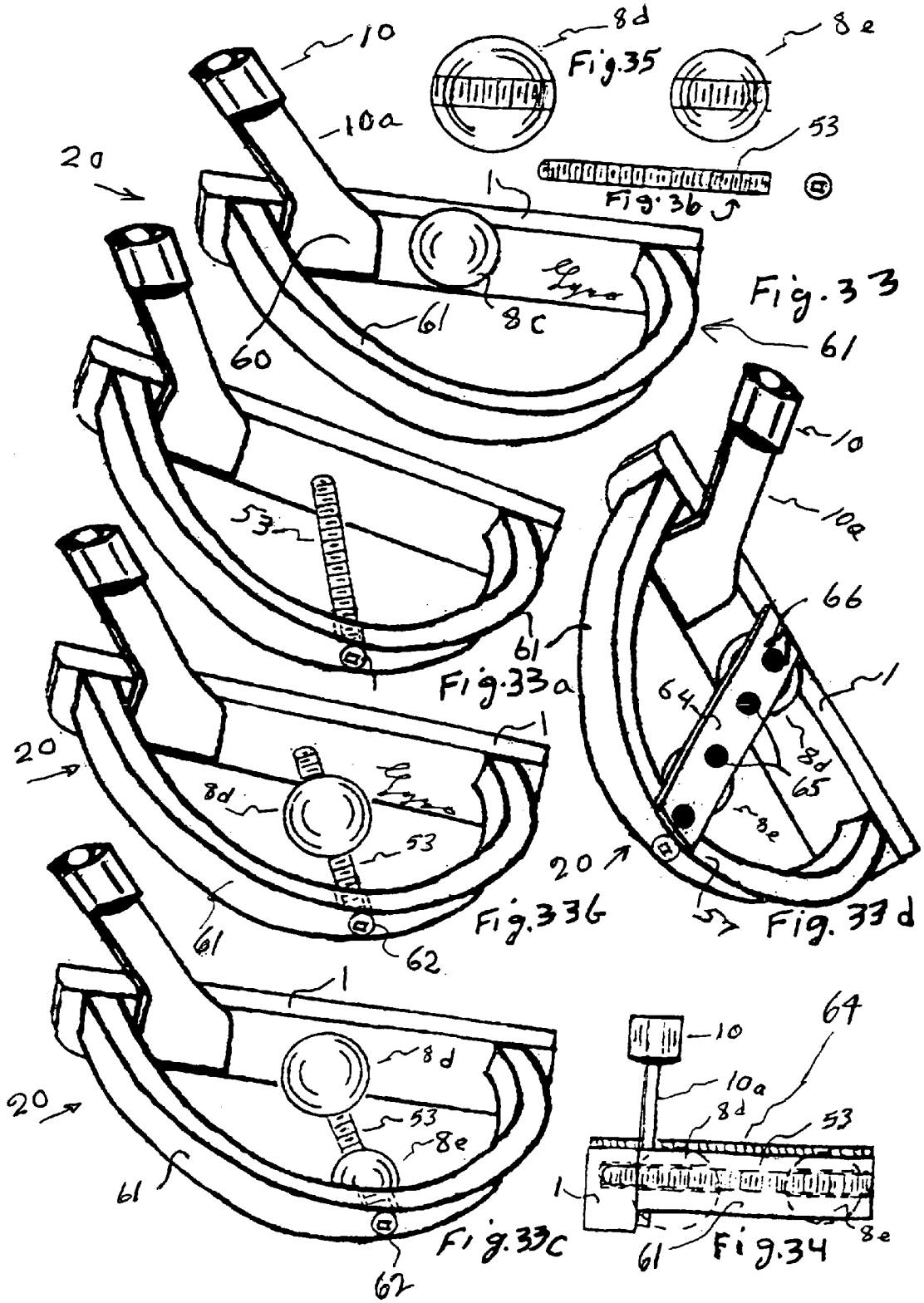
FIG. 33 is a perspective view of a gyro-type hybrid putter club head constructed in accordance with one embodiment of the present invention.
FIG. 33*a* is a perspective view of the embodiment of FIG. 33 on which a lead screw has been installed.
FIG. 33*b* is a perspective view like that of FIGS. 33 and 33*a,* wherein a weight has been installed on the lead screw.
FIG. 33*c* is a perspective view like that of FIGS. 33, 33*a,* and 33*b,* wherein a second weight has been installed on the lead screw.
FIG. 33*d* is a perspective view similar to FIG. 33*d,* wherein an alignment strip has been installed thereon.
FIG. 34 is a cross-sectional end view of the embodiment shown in FIG. 33*d;*
FIG. 35 is a view, in isolation, of spherical weights for use in the embodiments of FIGS. 33–34.
FIG. 36 is a view, in isolation, of a lead screw for use in the embodiments of FIGS. 33–34.

In FIGS. 33, 33*a*, 33*b*, and 33*c*, there is illustrated a modified embodiment of a gyro-type hybrid putter club head 20, which is a combined blade-type club head, having a blade 1, and a mallet-type club head, having a mallet-type body 61. This unique club head 20 may have disposed thereon a fixed weight 8*c*, as shown in FIG. 33, or may employ a lead screw 53 having a movable weight 8*d* disposed thereon, as shown in FIGS. 33*a* and 33*b*. Yet a third alternative is shown in FIG. 33*c*, wherein a plurality of weights 8*d* and 8*e* are disposed.

In this embodiment, the body frame 61 is preferably a semi-circular strip of metal, which is attached at its ends to the back surface of the blade 1, and includes a threaded hole 62 at its rear center, into which the axial lead screw 53 is threaded. The blade 1 preferably extends laterally less than about 0.75 inches beyond the respective sides of the frame 61, as shown, thus making it a hybrid putter head, whereas, in conventional putter heads, the blade is contained within the sides of the body.

With this advantageous arrangement, the weight 8*d* may be moved forwardly to the blade 1 or rearwardly to the body frame 61, along the lead screw 53 as shown in FIG. 33*b*, and positioned in a desired location along this range of motion. A second weight 8*e* (FIG. 33*c*) can also be added and located as desired, or fixed at the rear against the body frame 61.

In FIG. 33, a single weight 8*c* is fixedly located, with a screw or other suitable mounting means, at the back surface of the blade's center of gravity, as shown.

The embodiment of FIG. 33*d* is similar to that of FIG. 33*c*, but employs, in addition, an innovative alignment strip 64, on which are disposed a series of markers 65, and an arrow 66, for assisting in the alignment of the putter, disposed on the top of the club head.

Figure 37:
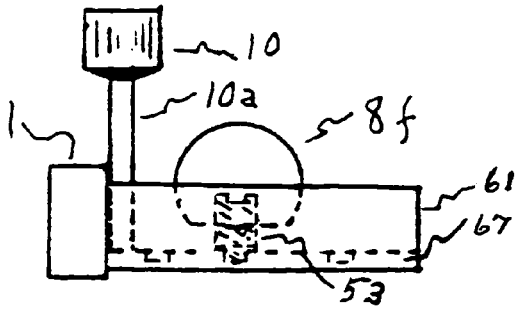
FIG. 37 is a right end view of a gyroscopic open mallet type putter club head, constructed in accordance with the principles of the present invention.
Figure 38:
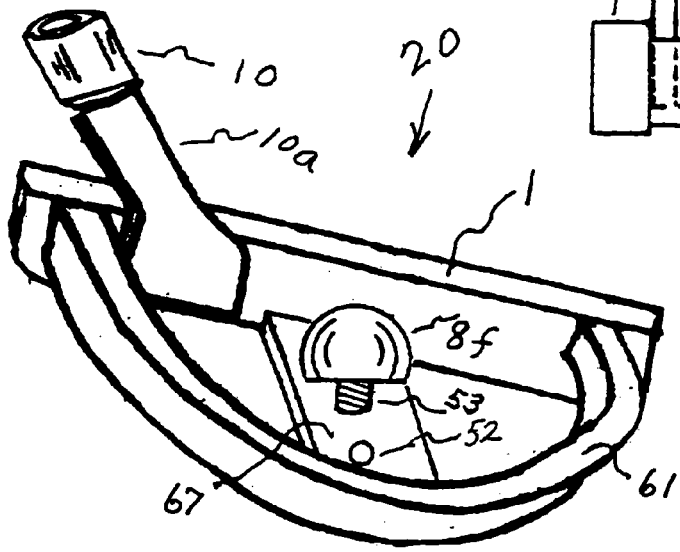
FIG. 38 is a perspective view of the embodiment of FIG. 37.

In FIGS. 37 and 38, there is shown another gyroscopic open mallet-type putter club head 20, which employs movable, adjustable weights, as shown. In this embodiment, a strip element 67 is attached to the back of the blade 1, and to the body frame 61 at its rear center. The strip element 67 is preferably disposed in an orientation generally perpendicular to the back surface of the blade, wherein the center line of the strip element is in-line with a perpendicular line, rearward from the center of gravity of the blade. One or more threaded holes 52 are disposed on a center line of the strip element 67. One or more threaded studs 53 may be disposed in one or more of the threaded holes 52. A weight 8*f*, preferably a semi-spherical weight, as shown, may be threaded onto the threaded stud 53, and may be adjusted upwardly or downwardly by the rotation of the weight relative to the threaded stud. Moving the stud 53 to alternate holes 52 on the strip element 67, and/or moving the weight 8*f* upwardly or downwardly on the stud, functions to change the location of the center of gravity of the club head, and to change the vertical impact point on the ball.

Figure 39:
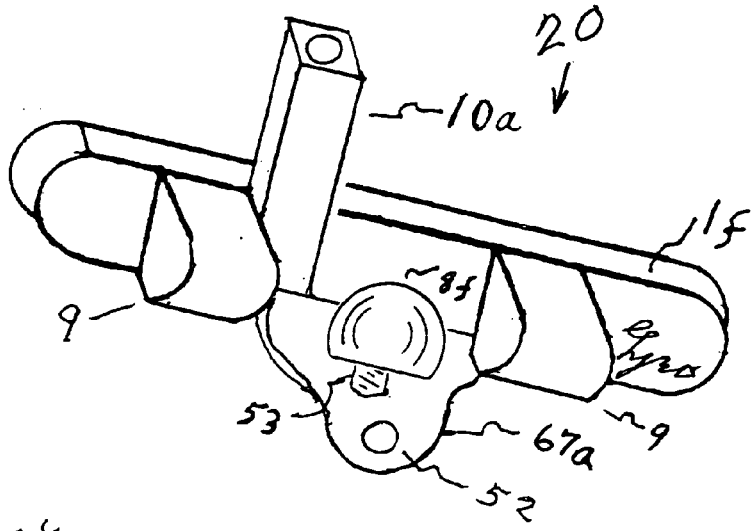
FIG. 39 is a perspective view of a modified version of the embodiment of FIG. 38.
Figure 40:
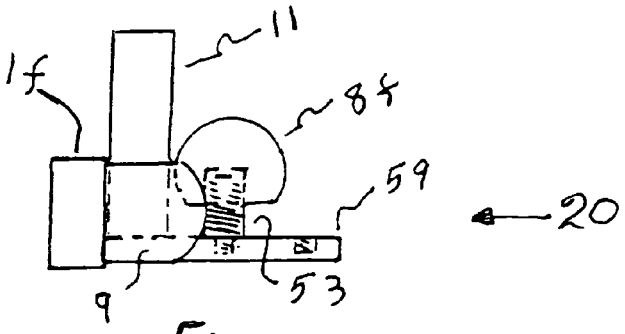
FIG. 40 is a plan view of the embodiment of FIG. 39.

In FIG. 39, a modified gyroscopic blade-type putter club head 20 embodies movable weights as in the FIG. 38 embodiment. In this embodiment, a plate element 67*a* is employed, while other elements are similar to those in the FIG. 38 embodiment, and other previously disclosed blade-type putter embodiments.

Figure 41:
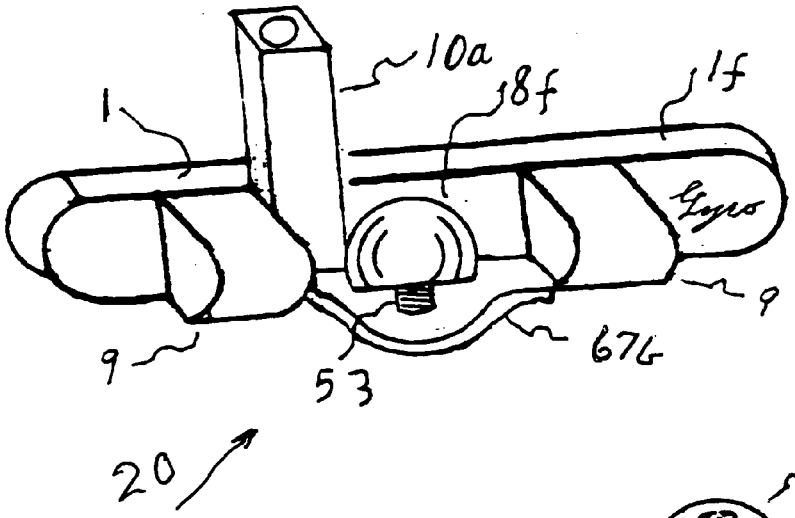
FIG. 41 is a perspective view of another putter club head embodiment having a single mounted spherical weight thereon.
Figure 42:
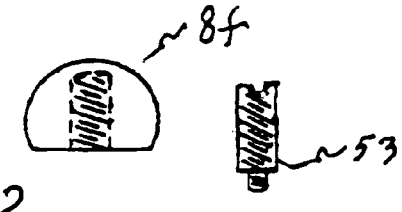
FIG. 42 is a cross-sectional view of a spherical weight for use in the embodiment of FIG. 41.

The FIG. 41 embodiment is very similar to the FIG. 39 embodiment, except for a slightly modified plate element 67*a*, on which only a single hole 52 and a single weight 8*f* are disposed.

Figure 43:
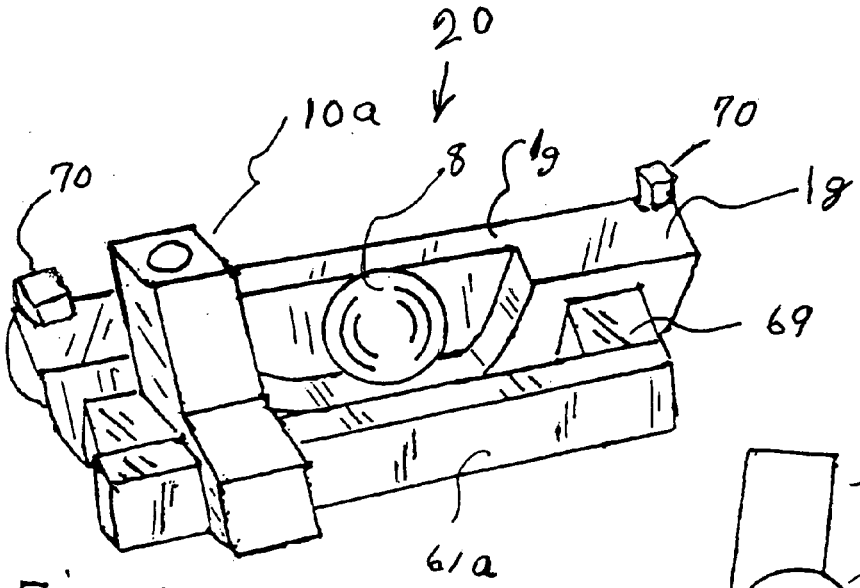
FIG. 43 is a perspective view of still another embodiment of a putter head constructed in accordance with the principles of the invention.
Figure 44:
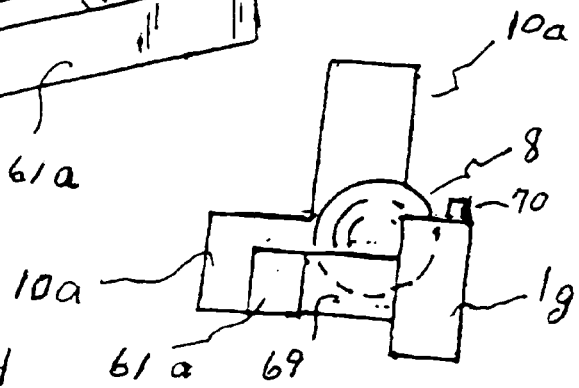
FIG. 44 is a plan view of the hosel portion of the club head shown in FIG. 43.

In FIGS. 43 and 44, there is illustrated still another hybrid gyroscopic mallet-type putter club head 20, which employs a straight frame 61*a*, rather than the semi-circular frame 61 of the previous embodiments. The frame 61*a* includes a frame extension 69 on each end, which extends to and is attached to the rear surface of the blade 1*g*. A hosel stem 10*a* is attached to the rear body frame for the attachment of the club shaft (not shown), as in previous embodiments. The club head may be cast in one piece from steel, aluminum, or the like. Alternatively, the frame may be cast in aluminum, and the blade cast in steel. Moreover, a weight 8 may be attached to the rear surface of the blade, at or near the center of gravity of the blade.

Not shown is an additional feature of the putter club, wherein the top edge of the front of the blade extends forwardly to form an angle of less than 10 degrees with the bottom edge of the blade. This feature causes the ball to be struck above its equator, thereby causing the ball to roll rather than to jump an impact.

This embodiment additionally comprises a marker 70, preferably comprising a pair of square sectional posts, less than ⅜ inches square and ⅜ inches high, an opposed sides of the blade 1*g*. These two posts 70, in operation function to form an imaginary long line, thereby providing a "T-square" effect and precise wide angles with the line to the target, thus enabling a quick and easy alignment of the club head with the target for an advantageous and more accurate putt.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A gyroscopic golf club head comprising:

a striking blade including a front striking area and a back surface located opposite to said front striking area;

said club having a predetermined center of gravity;

a threaded hole positioned on the back surface of the striking blade and substantially coincident with the center of gravity;

a spherical weight with a screw projecting therefrom and in line with the center of the spherical weight and being mounted on the back surface of the striking blade, said spherical weight being attached to said club head by said screw and being threadedly engaged within said threaded hole, said spherical weight being distanced substantially from surrounding club head material except at said attachment point between the screw and the threaded hole, in order to maximize the gyroscopic inertia of the golf club head in the "swing" motion of the golf club;

said club head including a hosel for the attachment of a golf club shaft.

2. The gyroscopic golf club head as recited in claim 1, wherein said screw extends outward at opposite ends of said spherical weight and through the geometric center of the spherical weight; said club head comprising a semi-circular band, the width of which is less than the height of the striking blade and being attached to the ends of the striking blade at the back surface of the blade; said spherical weight being rotatable and moveable along the length of the screw.

3. The gyroscopic golf club head as recited in claim 2 wherein the band comprises a threaded hole at the center of its arc and matching the threads of the screw and arranged in line with the hole at the back surface of the blade; said screw at one end of the spherical weight being threaded in to the hole at the back surface of the blade and the opposite end of the screw being attached into the hole at the center of the arc of the band, whereby the spherical weight is positioned and rotatable on the screw between the back surface of the blade and the center of the band.

4. A gyroscopic golf club head as recited in claim 1, wherein said club head is selected from the group consisting of "woods", "irons" and "putters".

5. A gyroscopic golf club head as recited in claim 1, comprising a bottom plate extending rearward from the bottom edge of the striking blade and having a center line perpendicular to a vertical line passing through the center of gravity of the striking blade;

a threaded hole on said center line, rearward from the striking blade, wherein the spherical weight, with the projecting screw, is threaded into said hole and mounted, in order to maximize the inertia of the golf club head in the "swing" motion of the golf club.

6. A gyroscopic golf club head as recited in claim 1, wherein said spherical weight, positioned at the back surface of said striking blade, is less than 1.0" from the center of gravity of the striking blade;

wherein said spherical weight is positioned and mounted on said striking blade, less than 1.0"from the center of gravity, toward the the of said striking blade, in order to maximize the inertia of the golf club head, in the "swing" motion of the golf club.

7. A gyroscopic golf club head comprising:

a club head body including a striking "face" as the striking surface, said club head body having a predefined center of gravity;

a cavity located rearwardly of the back of said striking face and defined, at least in part, by said club head body;

a spherical weight having uniform means, positioned and attached within said cavity and spaced from said club head body such that the center of gravity of said spherical weight is substantially concentric with the center of gravity of said club head; the density of the material, inside of the club head body, being less than the density of the material of the spherical weight, in order to maximize the inertia of the golf club head in the "swing" motion of the golf club;

said golf club head including a hosel for the attachment of a golf club shaft;

said golf club head selected from the group consisting of "woods", "mallets" and "irons".

* * * * *